US010302315B2

(12) United States Patent
Pine et al.

(10) Patent No.: US 10,302,315 B2
(45) Date of Patent: May 28, 2019

(54) PACKAGED AIR CONDITIONING SYSTEM HAVING MULTIPLE UTILITY CONNECTIVITY

(71) Applicant: Lennox Industries Inc., Richardson, TX (US)

(72) Inventors: Matthew Pine, Gadsden, AL (US); Dave Winningham, Richardson, TX (US); Jeff Butler, Richardson, TX (US)

(73) Assignee: Lennox Industries Inc., Richardson, TX (US)

( * ) Notice: Subject to any disclaimer, the term of this patent is extended or adjusted under 35 U.S.C. 154(b) by 78 days.

(21) Appl. No.: 15/692,927

(22) Filed: Aug. 31, 2017

(65) Prior Publication Data

US 2017/0363302 A1 Dec. 21, 2017

Related U.S. Application Data

(63) Continuation of application No. 13/685,177, filed on Nov. 26, 2012, now Pat. No. 9,759,434.

(51) Int. Cl.
*F17D 1/00* (2006.01)
*F24F 1/022* (2019.01)

(52) U.S. Cl.
CPC ..... *F24F 1/022* (2013.01); *F17D 1/00* (2013.01); *Y10T 29/49117* (2015.01); *Y10T 29/49359* (2015.01); *Y10T 137/6416* (2015.04)

(58) Field of Classification Search
CPC ..... F16L 2201/00; F24F 1/022; F24F 7/04; F24F 1/0003; F24F 1/60; F24F 2221/32; F24F 1/32; F17D 1/00; Y10T 137/6416; Y10T 29/49359
See application file for complete search history.

(56) References Cited

U.S. PATENT DOCUMENTS 2,450,744 A * 10/1948 Whitehead ..... F24C 3/085 126/39 N
3,277,956 A * 10/1966 Hughes ..... F24F 1/02 165/64
3,627,031 A * 12/1971 Ware ..... F24F 3/06 165/218
4,171,772 A * 10/1979 Hays ..... F24D 3/02 237/8 R
4,274,581 A * 6/1981 Hays ..... F24D 3/18 237/7
4,554,796 A * 11/1985 Stankard ..... F24F 1/06 62/326
5,478,121 A * 12/1995 Foti ..... F16L 27/0861 137/613
5,911,563 A * 6/1999 Duppert ..... F04D 29/626 310/91
7,398,778 B2 * 7/2008 Kaiser ..... F24F 3/001 126/101

(Continued)

*Primary Examiner* — Devon Russell
(74) *Attorney, Agent, or Firm* — Winstead PC

(57) ABSTRACT

One aspect of this disclosure provides a packaged air conditioning & heating (PACH) system that comprises a housing, an air cooling system contained within the housing and an air heating system contained within the housing. A first utility access point is located on a first side of the housing and a second utility access point is located on a second side of the housing. The first and second utility access points provide multiple utility access connectivity for the air cooling and heating systems.

17 Claims, 3 Drawing Sheets

(56) References Cited

U.S. PATENT DOCUMENTS

| | | | | |
|---|---|---|---|---|
| 7,544,077 | B1 * | 6/2009 | Martin | H01R 25/161 200/16 R |
| 8,004,827 | B2 * | 8/2011 | Ewing | H01R 13/68 174/59 |
| 8,207,627 | B2 * | 6/2012 | Aldag | H01R 25/142 307/12 |
| 8,925,176 | B2 * | 1/2015 | Choi | F16L 19/086 29/464 |
| 2005/0032416 | A1 * | 2/2005 | Peress | H01R 13/465 439/502 |
| 2006/0213496 | A1 * | 9/2006 | Kimble | F24C 3/12 126/39 N |
| 2008/0164006 | A1 * | 7/2008 | Karamanos | F24F 1/0059 165/67 |
| 2010/0070090 | A1 * | 3/2010 | Mirpourian | F24F 5/0085 700/278 |
| 2010/0193052 | A1 * | 8/2010 | Watkins | E03B 3/03 137/565.01 |
| 2011/0167670 | A1 * | 7/2011 | Stamm | F24F 3/1405 34/491 |
| 2011/0245988 | A1 * | 10/2011 | Ingels | G06F 1/26 700/295 |
| 2011/0286168 | A1 * | 11/2011 | Scheucher | H02J 7/0045 361/679.01 |
| 2012/0086275 | A1 * | 4/2012 | Chatterjee | H02J 1/10 307/52 |
| 2012/0266987 | A1 * | 10/2012 | Jaasma | F02D 19/0647 137/602 |
| 2012/0293921 | A1 * | 11/2012 | Makwinski | H02G 3/0608 361/624 |
| 2013/0091883 | A1 * | 4/2013 | Perez | F25B 30/02 62/203 |
| 2013/0316637 | A1 * | 11/2013 | Kawano | F24F 7/007 454/338 |

* cited by examiner

PACKAGED AIR CONDITIONING SYSTEM HAVING MULTIPLE UTILITY CONNECTIVITY

CROSS REFERENCE TO RELATED INFORMATION

This application is a continuation of U.S. patent application Ser. No. 13/685,177, filed Nov. 26, 2012, titled "Packaged Air Conditioning System Having Multiple Utility Connectivity", now U.S. Pat. No. 9,759,434, the contents of which are hereby incorporated herein in its entirety.

TECHNICAL FIELD

This application is directed to a packaged air conditioning and heating system having multiple utility connectivity.

BACKGROUND OF THE INVENTION

Packaged air conditioning and heating (PACH) systems have gained market share in residential and commercial applications, because they are an ideal solution when indoor space is at a premium. These units have the same components as typical split systems, but are engineered to contain all of the components in a split system in one streamlined cabinet. These PAC systems are typically installed on a rooftop or on the ground outside the building, connecting to the ductwork through a secure opening in the outside wall. They also provide easy access for serviceability, and need only to be connected to the air duct system of the residential or commercial building, thereby requiring no space within the building itself. These PAC systems may be powered by a combination of electricity and gas or may be powered by electricity alone.

BRIEF SUMMARY OF THE INVENTION

One aspect provides a packaged air conditioning (PACH) system that comprises a housing, an air cooling system contained within the housing and an air heating system contained within the housing. A first utility access point is located on a first side of the housing and a second utility access point is located on a second side of the housing. The first and second utility access points provide multiple utility access connectivity for the air cooling and heating systems.

In another embodiment, the PACH system comprises a housing, an air cooling system contained within the housing, an air heating system contained within the housing, and a utility control center located within the housing that includes an air cooling and heating system controller. A first utility access point is located on a first side of the housing and comprises a first electrical or gas line extending from the first utility access point through the housing and to the utility control center. A second utility access point is located on a second side of the housing and comprises a second electrical or gas line extending from the second utility access point through the housing and to the utility control center, thereby providing multiple utility access connectivity for the air cooling and heating systems.

Another embodiment provides a method of manufacturing a PACH system. This embodiment comprises providing a housing, placing an air cooling system within the housing, placing an air heating system within the housing, placing a first utility access point on a first side of the housing, and placing a second utility access point on a second side of the housing. The first and second utility access points provide multiple utility access connectivity for the air cooling and heating systems.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
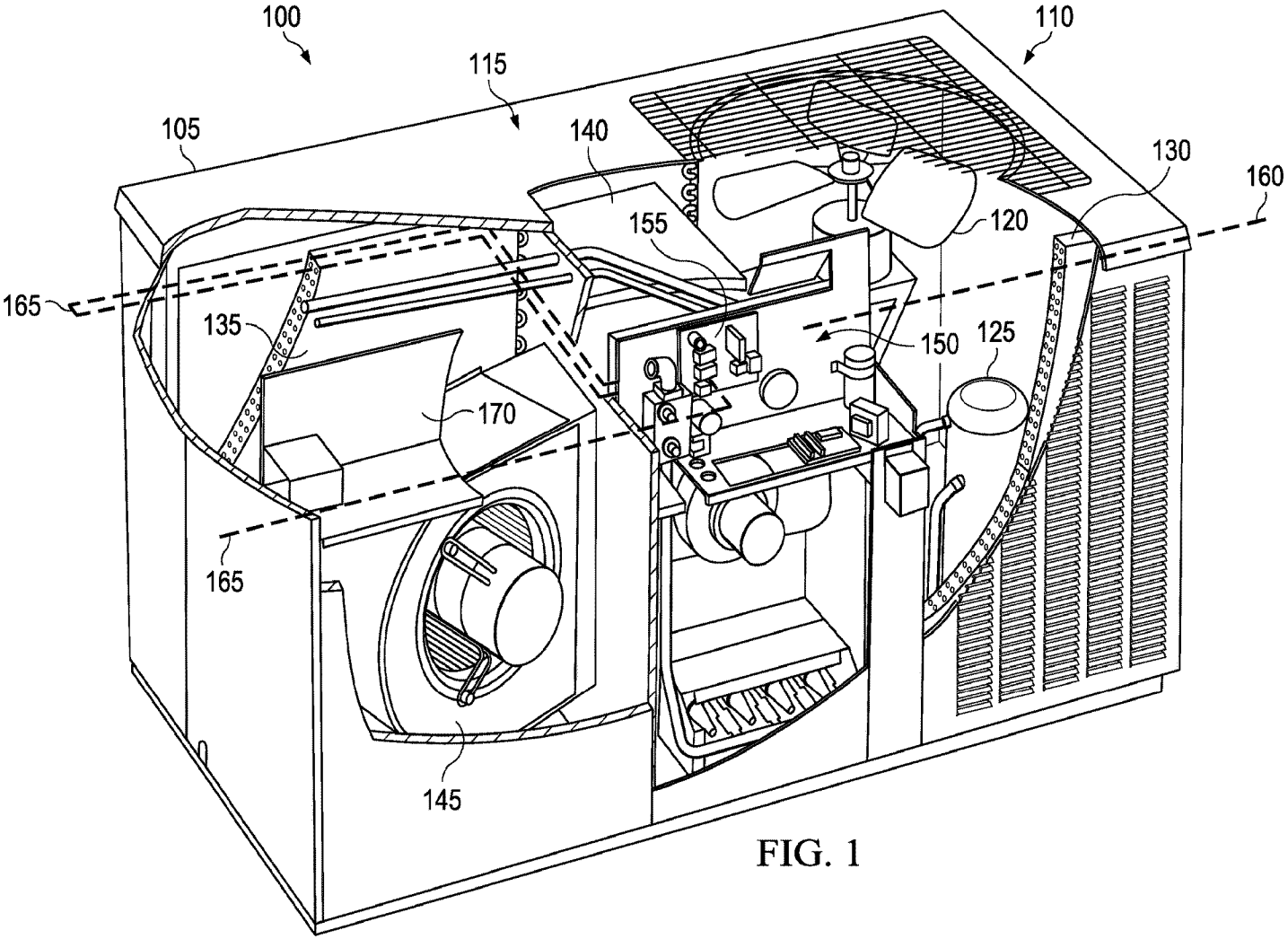
FIG. 1 illustrates one embodiment of a PACH system as provided by this disclosure.

FIG. 1 illustrates an embodiment of a PACH system 100 as provided by this disclosure. The illustrated PACH includes a housing 105 that houses an air cooling system 110 and an air heating system 115. The air cooling system 110 may be of conventional design that includes components, such as an outdoor fan, 120, a compressor 125, a condenser 130, and an evaporative coil 135. The air heating system 115 may also be of conventional design that includes components, such as a heat exchanger 140, and an air circulation blower fan 145. The PACH system 100 further includes a control center 150 at which utilities can be connected to the PACH system 100. In one embodiment, the control center 150 includes a conventional controller 155 that controls the operation of the air cooling and heating systems 110, 115. It should be noted that the controller 155 need not be located in the control center 150, but may be located adjacent the control center 150 or distal from it elsewhere within the housing 105.

The PACH system 100 further includes first and second utility access points 160, 165, which generally show examples of different locations at which the respective utility access points 160, 165 may be placed. In one embodiment, the first utility access point 160 is located on a first side of the housing 105 that is opposite to the alternative positions of the second utility access point 165 as shown FIG. 1. However, in an alternative embodiment, the first utility access point may be the control center 150. As used herein and in the claims, an "access point" is a location on the housing at which a utility supply that is external to the PACH system 100 itself can be connected to the PACH system 100 and includes either internal wiring or tubing necessary for connecting the PACH system 100 to the external utility electrical or gas supply. In an alternative embodiment, the access point may be a location on the housing 105 that is configured to receive field-ready supplied wires or tubing that are configured to extend to a connection point within the housing of the PACH system 100, that is they have a length and appropriate fittings for making connection to the external utility and to the PACH system 100. In such embodiments, the PACH would be designed to accommodate a field installed accessory wire harness or tubing in the housing 105 that would enable field connections from multiple locations, if desired. The housing 105 would have internal housing panels to accommodate the field installation of the harnesses, tubing or both. Further in such embodiments, the housing 105 will have structures, such as conduits, chases, or hanger supports that are configured to receive the field-ready wire or tube.

The second utility access point 165 is shown to indicate how either the first or second utility access points 160, 165 may be generally located on the sides of the housing 105. For example, they may be located near the front end of the PACH system 100 or positioned more toward the rear of the PACH system 100, as generally indicated by the second utility access point 165, thereby providing further installation versatility. The first utility access point 160 may also be positioned in the same manner but on a different side of the housing 105 from that of the second utility access point 165. The first and second utility access points 160, 165 provide multiple utility access connectivity for the air cooling and heating systems 110, 115. It should be noted that each of the first and second utility access points 160, 165 may provide for more than one utility. For example, if the PACH system 100 is an all electric unit, then the first and second utility access points 160, 165 will include only electrical wiring. However, if the PACH system 100 is configured to operate on both electric and gas, then the first and second utility access points 160, 165 will be configured for both electric and gas. Other power sources, such as fluids (like water for water sourced air conditioners/heat pumps) could also be connected at the access points. As can be seen by these few examples, the number of combinations of access points and how they are arranged can vary.

In another embodiment, the control center 150 may serve as an internal connection point within the PAC system 100 for utilities that extend from the first and second utility access points 160, 165 that are located on opposite sides of the PAC system 100, to thereby provide electrical or gas supply to the air cooling and heating systems 110, 115. It should be noted that the use of the word "or" as used herein and in the claims includes both the conjunctive and disjunctive forms. Thus, for example, the first and second utility access points 160, 165 may include only electrical, or they may include both electrical and gas configurations. The PACH system 100 also includes a ducting system 170 that can be used to tie into existing ducting within the residence or commercial building.

The PACH system 100, as provided herein, provides a unique combination of additional access points pre-built into the PACH system, which allow the installer a number of options for connecting the unit, when the utilities are not conveniently positioned with respect to the installation sight for the PACH system 100. Thus, the installer can maximize the position and orientation of the PACH system 100 for the easiest access and serviceability, or lowest installation costs. These access points 160, 165 are counter-intuitive to standard manufacturing practices that seek to minimize cost in the production of conventional PACH units by reducing internal parts whenever possible. However, it has been realized with this disclosure that the costs associated with including additional access points is significantly off-set by the option that the PACH system 100 offers an installer the ability to optimize its installation position or orientation, which can reduce installation costs and time and provide easier access and serviceability.

Figure 2:
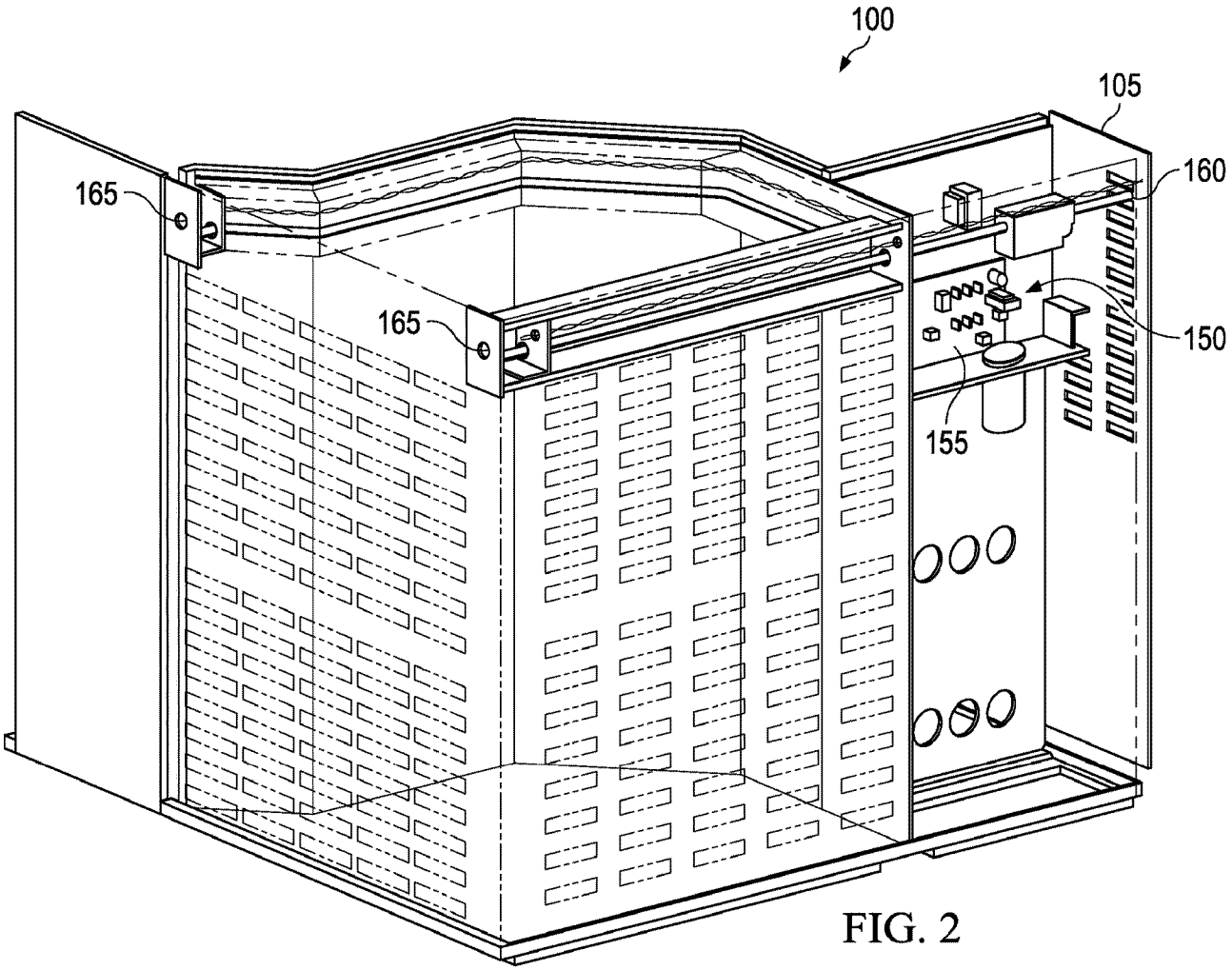
FIG. 2 illustrates a different PACH system with similar embodiment as FIG. 1.

FIG. 2 is an alternate design PACH system 100 with different component positions than FIG. 1, but is also an example of one embodiment. In this embodiment, the control center 150 serves as a common internal connection area for utilities running from the first utility access point 160 located on one side of the housing 105 and the second utility access point 165 extending from an opposite side of the PACH system 100. For example, the first utility access point 160 may be located on the right side of the housing 105 and extend to the control center 150, while the second utility access point 165 may be located on the left side of the housing 105, either at the front or more toward the rear, as shown, and extend to the control center 150. As stated previously, the number of access points for each of the first and second utility access points 160, 165 may vary and not need be as shown but can vary as design requires. The control center 150 may also be of conventional design and include the controller for controlling the operation of the PAC system 100. The external ends of the access points 160, 165 located at the sides of the housing 105 are configured to connect to an external electrical or gas utility supply, while their internal ends are configured to connect to an electrical interface or gas union or valve located within the PACH system 100, which in the illustrated embodiment is located at control center 150.

Figure 3:
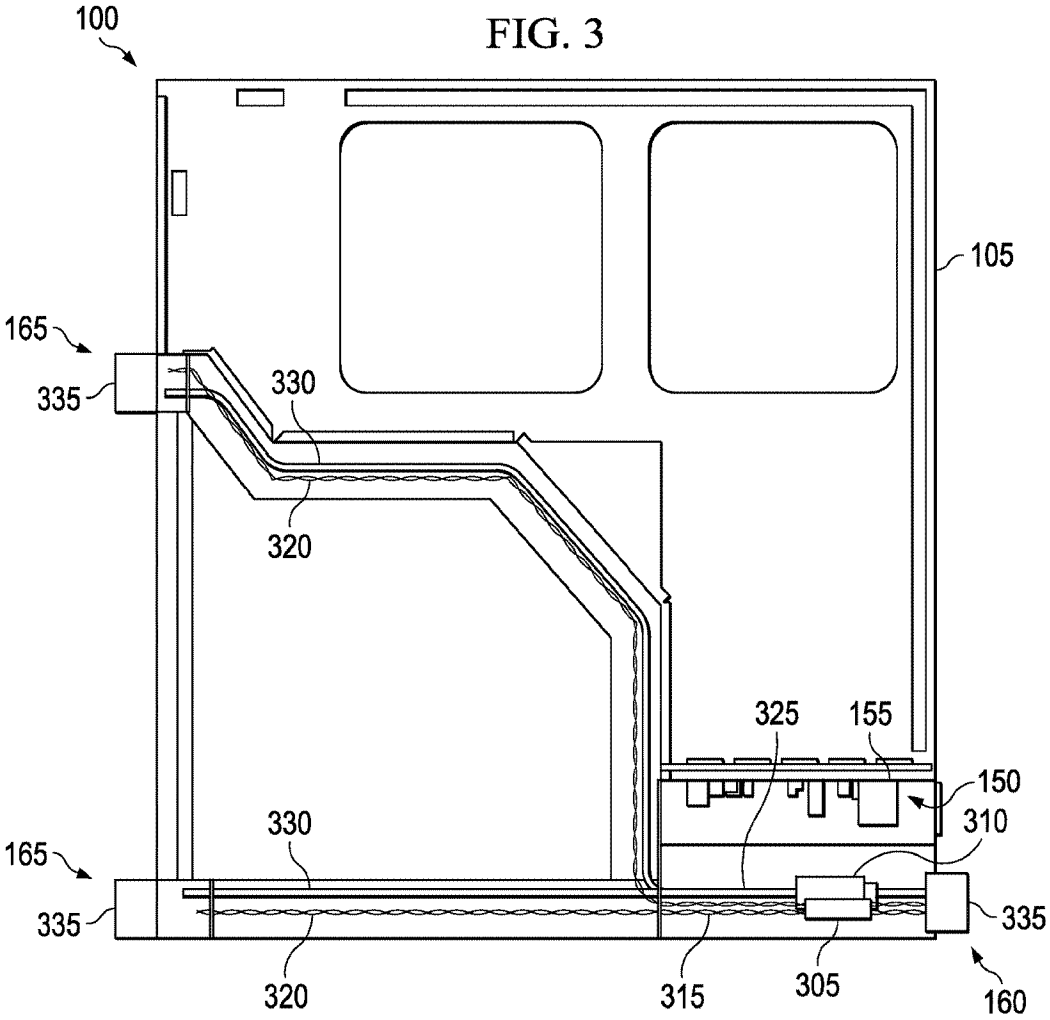
FIG. 3 illustrates an overhead view of the PACH systems of FIG. 2.

FIG. 3 illustrates an overhead view of an embodiment of the PACH system 100, shown in FIG. 2. This embodiment comprises a conventional electrical connector 305 or conventional gas control valve 310 located within the housing 105, and in one embodiment, within the control center 150. The electrical connector 305 and gas control vale 310 are preferably connected to the controller 155 that will control their respective operations within the PAC system 100. The first and second utility access points 160, 165 respectively include first and second electrical wires 315, 320 or a gas line 325, 330 that extend within the housing 105 from the first and second sides of the housing 105 to the electrical connector 305 or gas control valve 310, respectively. In another embodiment, the first and second utility access points 160, 165 may further comprise a conventional electrical or gas connection interface 335 located on an exterior of the first and second sides of the housing 105. The first and second utility access points 160, 165 are respectively configured to have an electrical wire or gas supply line that is exterior to the PACH system 100 connected to it. The electrical and gas connection interfaces 335 may be of conventional design. For example, the electrical connectors may be a negative and positive post terminals to which the electrical wires can easily be connected, while the gas connector may be a threaded end of the gas tubes 325, 330.

With reference to FIGS. 1-3, the present disclosure also provides a method of manufacturing the PACH system 100. In one embodiment, the method includes providing the PACH housing 105. As used herein and in the claims, "providing" means that the housing may be manufactured internally or may be obtained from a supplier. The conventional air cooling and heating systems 110 and 115 are placed within the housing 105. The first utility access point 160 is located on a first side of the housing 105, and the second utility access point 165 is located on a second side of the housing 105. In another embodiment, the method may further include placing a utility control center 150 within the housing 105 that includes a controller 155 for controlling an operation of the air cooling and heating systems 110, 115. In one embodiment, placing the first access point 160 within the housing 105 comprises extending a first electrical or gas line 315, 325 from the first side of and through the housing 105 to the utility control center 150, and placing the second utility access point 165 comprises extending a second electrical or gas line, 320, 330 from the second side of and through the housing 105 and to the utility control center 150. The first and second access points 160, 165, in one embodiment, can be connected to an electrical or gas interface located in the utility control center 150, or the connection points may, in other embodiments be outside the control center 150, yet still internal the housing 105. In another embodiment, placing the first and second utility access points 160, 165 include placing an electrical or gas connection interface 335 for the air cooling and heating systems 110, 115 on an exterior of the first and second sides of the housing 105. A duct access system configured to be connectible to a duct system of a residential or commercial building may is also placed within the housing 105, in another embodiment. In yet another embodiment, placing the first and second utility access points 160, 165 include placing an electrical wire or a gas line 315, 325 and 320, 330, respectively, that extend within the housing from the first and second sides of the housing 105 to an electrical connector 305 or gas valve 310 located within the housing 105, to thereby supply a utility to the PACH system 100.

Those skilled in the art to which this application relates will appreciate that other and further additions, deletions, substitutions and modifications may be made to the described embodiments.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A packaged air conditioning and heating (PACH) system, comprising:

a housing;

an air cooling system contained within said housing;

an air heating system contained within said housing;

a control center operable to control the air cooling system and the air heating system;

a first number of utility supply access points located on a first exterior side of said housing;

a second number of utility supply access points located on an opposite exterior side of said housing;

said first and second number of utility supply access points providing access for multiple utility lines to be independently coupled to the control center.

2. The PACH system of claim 1, further comprising an electrical connector or gas connector located with said housing and wherein said first and second number of utility access points include an electrical wire or a gas line that extends within said housing from said first and second sides of said housing to said electrical connector or gas line.

3. The PACH system of claim 1 wherein said first and second number of utility access points are configured to receive field ready supplied wires or tubing that is configured to extend to a connection point within said housing.

4. The PACH system of claim 1, wherein the control center comprises an electrical connection interface or a gas control valve that are respectively connected to electrical wires or gas lines that extend from said first number of utility access points and that are respectively connected to electrical wires or gas lines that extend from said second number utility access points.

5. The PACH system of claim 4, wherein said first and second number of utility access points include an electrical or gas connection interface located on an exterior of said first and second exterior sides and respectively configured to have an electrical wire or gas supply line exterior to said PACH system connected thereto.

6. The PACH system of claim 4, wherein said control center includes an air cooling and air heating systems controller.

7. The PACH system of claim 1, wherein said housing is configured to be connectible to a duct system of a residential or commercial building.

8. A packaged air conditioning and heating (PACH) system, comprising:

a housing;

an air cooling system contained within said housing and comprising an outdoor fan, a compressor, a condenser, and an evaporative coil;

an air heating system contained within said housing and comprising a heat exchanger and an air circulation blower fan;

a utility control center located within said housing, said utility control center including an air cooling and heating system controller;

a first number of utility supply access points located on an exterior side of said housing and comprising supply lines extending from said first number of utility supply access points through said housing and to said utility control center; and a second number of utility supply access point S located on an opposite exterior side of said housing and comprising supply lines extending from said second number of utility supply access points through said housing and to said utility control center;

wherein the first and second number of utility supply access points comprise an external end configured to connect to an external utility supply line.

9. The PACH system of claim 8, wherein said first and second number of utility supply access points further comprise connections for electrical lines.

10. The PACH system of claim 8, wherein said first number of utility supply access points comprises an electrical supply line and a gas supply line.

11. The PACH system of claim 8, wherein said housing is configured to be connectible to a duct system of a residential or commercial building.

12. A method of manufacturing a packaged air conditioning (PACH) system, comprising:

providing a housing;

placing an air cooling system within said housing;

placing an air heating system within said housing;

placing a utility control center within said housing, the control center operable to control the air cooling system and the air heating system;

placing a first number of utility supply access points on an exterior side of said housing; and placing a second number of utility supply access points on an opposite exterior side of said housing;

wherein said first and second number of utility supply access points provide access for multiple utility supply lines to be independently coupled to the utility control center.

13. The method of claim 12 wherein:

placing said first number of utility access points comprises extending first gas lines from said first number of utility access points through said housing and to said utility control center; and placing said second number of utility access points comprises extending second gas lines from said second number of utility access points through said housing and to said utility control center.

14. The method of claim 12, wherein placing said first and second number of utility access points comprise placing a gas connection interface for said air cooling and heating systems on an exterior of said first and second exterior sides of said housing.

15. The method of claim 12, wherein providing said housing includes providing a duct system within the housing that is configured to be connectible to a duct system of a residential or commercial building.

16. The method of claim 12, wherein placing said first and second number of utility access points includes placing a gas line that extends within said housing from said first and second sides of said housing to a gas connector located within said housing, to thereby supply a utility to said PACH system.

17. The method of claim 12, wherein placing said first and second utility access points includes preparing internal housing structures configured to receive field-ready gas tubing that extends within said housing from said first and second number of access points to a gas connector located within said housing, to thereby supply a utility to said PACH system.

* * * * *